United States Patent [19]

Stewart

[11] Patent Number: 4,712,374

[45] Date of Patent: Dec. 15, 1987

[54] HYDRAULIC PUMP JACK

[76] Inventor: Wayne A. Stewart, 608 W. 10th, McCook, Nebr. 69001

[21] Appl. No.: 291,518

[22] Filed: Aug. 10, 1981

[51] Int. Cl.[4] ..... F16D 31/02; F01L 31/00

[52] U.S. Cl. ..... 60/369; 91/279

[58] Field of Search ..... 60/364; 91/277, 279; 417/401

[56] References Cited

U.S. PATENT DOCUMENTS 245,101 8/1881 Thayer et al. ..... 91/279 X 2,351,872 6/1944 Parker ..... 91/279 X

*Primary Examiner*—William L. Freeh

*Attorney, Agent, or Firm*—Zarley, McKee, Thomte, Voorhees & Sease

[57] ABSTRACT

A hydraulic pump jack is disclosed which utilizes a hydraulic cylinder to provide pumping force to an oil well sucker rod. The hydraulic pump jack may be directly mounted on an oil well casing either above or below ground. A tubular piston rod which may be connected to a sucker rod in telescoping relation for transmitting vertical force without side loading is also disclosed. Apparatus for mounting the piston rod within a cylindrical housing is described. The use of a counter weight system for balancing the pump load is also described.

1 Claim, 7 Drawing Figures

HYDRAULIC PUMP JACK

BACKGROUND OF THE INVENTION

The present invention relates generally to pump jacks and more specifically to hydraulic pump jacks for oil wells and other applications.

Oil well pump jacks have traditionally consisted of complex mechanical devices with linkage units for transforming rotary motion from motors into the reciprocating motion needed for pumping. Conventional pump jacks generally require a relatively large amount of space in order to provide adequate clearance for the various moving parts and have necessarily been positioned aboveground. These pump jacks also require firmly anchored base supports or support pads in order to properly align the drive unit of the apparatus with the sucker rod of the oil well. The size and clearance requirements associated with traditional oil well pump jacks have proven to be a problem in agricultural areas utilizing center pivot irrigation systems and other large farm machinery. In addition, above ground pump jacks tend to be noisy and unsightly, thereby making oil wells aesthetically undesirable in populated or scenic areas. A further disadvantage of conventional pump jacks is the tendency of systems having multiple moving parts to break down at frequent intervals. If the number of moving parts in such systems are reduced, then desirable pumping characteristics having to do with pump stroke length and speed are generally sacrificed.

A need exists for an oil well pump jack which is reliable and which can also operate in a confined space. The pump jack should be capable of adaptation to different types of oil wells and should be capable of providing desirable pump stroke performance.

SUMMARY OF THE INVENTION

The present invention is a hydraulic pump jack which is constructed in a compact unit that may be directly attached to the head casing of an oil well.

Accordingly, it is a primary object of the present invention to furnish a hydraulic pump jack in a self-contained unit.

It is a further object of the present invention to provide a pump jack that may be attached directly to the head of an oil well casing.

It is a further object of the present invention to provide a pump jack that may be mounted below the ground surface.

It is a further object of the present invention to provide a pump jack that has a hydraulic valve system which allows a hydraulic cylinder to be operated at a preselected speed.

It is a further object of the present invention to provide a pump jack that has a hollow piston shaft for connection with an oil well sucker rod.

It is a further object of the present invention to provide a pump jack that may be powered by an electric or fossil fuel pump motor.

It is a further object of the present invention to provide a pump jack that has an adjustable stroke length.

It is a further object of the present invention to provide a pump jack that has a cooling chamber for hydraulic fluid.

It is a further object of the present invention to provide a pump jack that has relatively few moving parts.

It is a further object of the present invention to provide a pump jack that is compact in size.

It is a further object of the present invention to provide a pump jack that may be placed in a manhole type vault.

It is a further object of the present invention to provide a pump jack which may be easily removed from an oil well for repairs with a boom truck.

It is a further object of the present invention to provide a pump jack with a piston which does not produce a side thrust on the sucker rod.

It is a further object of the present invention to provide a pump jack which will not slip on a mounting pad.

It is a further object of the present invention to provide a pump jack which will be nearly maintenance free.

It is a further object of the present invention to provide a pump jack which may be built in a variety of sizes.

It is a further object of the present invention to provide a pump jack which eliminates the need for a pitman and mechanical gears.

It is a further object of the present invention to provide a pump jack which is contained in a cylindrical housing.

It is a further object of the present invention to provide a pump jack which is equipped with a shear pin at the connection with the sucker rod.

It is a further object of the present invention to provide a pump jack which may utilize counterweights.

It is a further object of the present invention to provide a pump jack which has an integrated hydraulic pump and control assembly contained in a sub unit mounted on the pump jack housing.

It is a further object of the present invention to provide a pump jack which is aesthetically pleasing in appearance.

It is a further object of the present invention to provide a pump jack that is safe to operate.

It is a further object of the present invention to provide a pump jack that is relatively inexpensive to construct and maintain.

DESCRIPTION OF THE PREFERRED EMBODIMENTS

Figure 1:
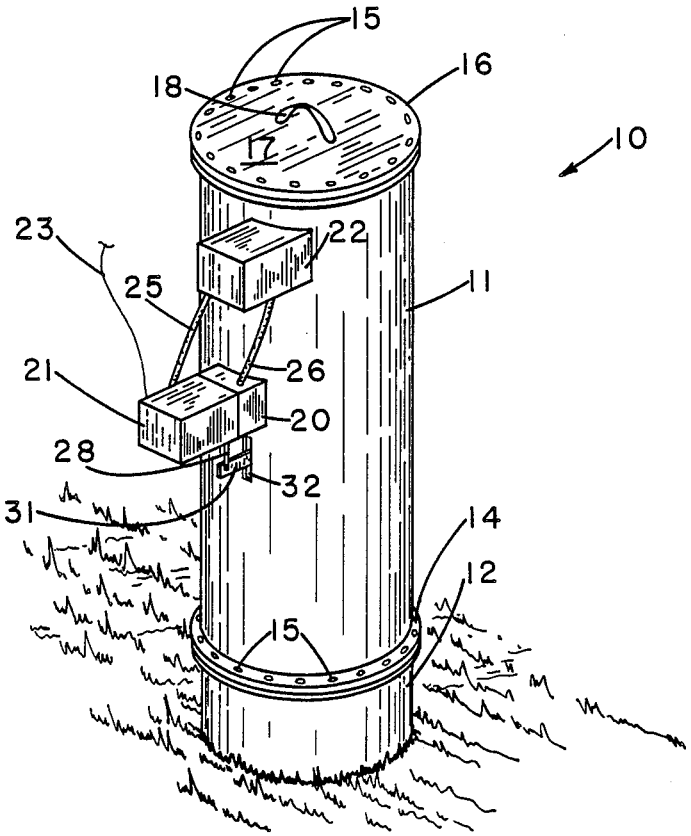
FIG. 1 is a perspective view of a hydraulic pump jack.
Figure 2:
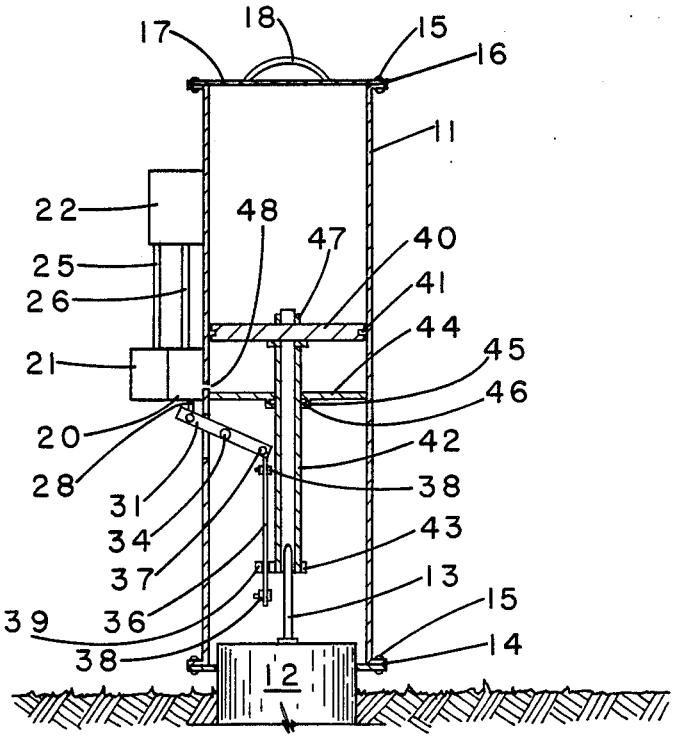
FIG. 2 is a cross-sectional view of a hydraulic pump jack showing the piston in its up stroke motion.

As shown by FIG. 1, the hydraulic pump jack 10 of the present invention has a generally cylindrical shape. The cylinder body 11 is mounted vertically on an oil well casing 12 by means of a collar arrangement 14 and mounting bolts 15. The collar arrangement 14 allows the pump jack 10 to be securely affixed to the oil well casing 12 and yet, allows the pump jack 10 to be easily removed for repairs or routine maintenance. A blind end cap 17 positioned at the top of the cylinder body 11 is also provided with a collar arrangement 16 which allows the cap 17 to be removed; thus, providing access to the piston 40 for maintenance purposes. As shown by FIG. 2, a piston 40 provided with piston seals or rings 41 is slideably mounted within the pump jack cylinder body 11. A piston rod 42, coaxial with the longitudinal axis of the cylinder 11, is secured to the piston 40 by means of a bolt 47, or other conventional attachment means well known in the art. A rod end cap 44 is welded, or otherwise rigidly attached to the interior wall of the cylinder 11, and is provided with a rod bearing 45 and rod packing 46 for accepting a piston rod 42 in sliding and sealing contact. The piston rod 42 is tubular and adapted to accept an oil well sucker rod 13 in a telescoping relationship, as shown in FIG. 2. A piston rod collar 43 allows the piston rod 42 to be attached to the sucker rod 13 at a pre-selected position. It will be seen that this telescoping arrangement provides for straight line pumping and prevents side thrust on the sucker rod 13.

As shown in FIGS. 1 and 2, a valve unit 20 is positioned on the side of the pump jack cylinder 11 and communicates with the upper portion of the cylinder 11 cavity through an orifice 48. The valve unit 20 is preferably bolted, or otherwise removably mounted on the cylinder 11, to facilitate removal for maintenance purposes. A hydraulic pump unit 21 is mounted adjacent to the valve unit 20 and provides hydraulic fluid under pressure to the valve unit 20. A fluid reservoir 22 is attached to the cylinder 11 directly above the valve unit 20 and pump unit 21. A hydraulic unit supply line 25 places the reservoir 22 in fluid communication with the pump unit 21 and a hydraulic fluid return line 26 provides fluid communication between the reservoir 22 and the valve unit 20. In the preferred embodiments, the hydraulic pump unit 21 contains an electric motor (not shown) which is energized by means of a power supply line 23. However, fossil fuel motors (not shown) could also be used and may be required in many remote areas. The particular configuration of the valve unit 20, pump unit 21 and return reservoir unit 22, as shown in the preferred embodiments, could, of course, be modified for various circumstances. For example, it might be desirable to maintain the reservoir unit 22 and pump unit 21 separate from the pump jack cylinder 11. These units 22, 21 would then be connected to the valve unit 20 with appropriate hydraulic fluid lines. This second type of arrangement might be particularly desirable when the pump jack 10 is mounted below ground, as shown in FIG. 5, or when the hydraulic fluid pump motor (not shown) is a fossil fuel type, which is more conveniently maintained at ground level.

As shown in FIG. 2, a valve actuator rod 28 projects downward from the valve unit 20 and is pivotally connected to one end of a pivot bar 31. A pivot bar opening 32 in the wall of the cylinder 11 below the rod end cap 44 allows the pivot bar 31 to enter the lower portion of the cylinder 11 cavity. The pivot bar 31 is pivotally mounted on a pivot bar shaft 34 which is welded or otherwise conventionally attached to the interior walls of the cylinder 11 below the rod end cap 44. The end of the pivot bar 31 positioned inside the cylinder 11 is pivotally attached to a pump stroke adjuster bar 36. The lower end of the adjuster bar 36 is slideably mounted within an adjuster bar guide 39, which is in turn welded or otherwise conventionally attached to the lower end of the piston rod 42. Adjuster stops 38 are slideably bolted to the adjuster bar 36 and may be moved up or down to produce a desired pump stroke length as will be more fully described below.

Figure 3:
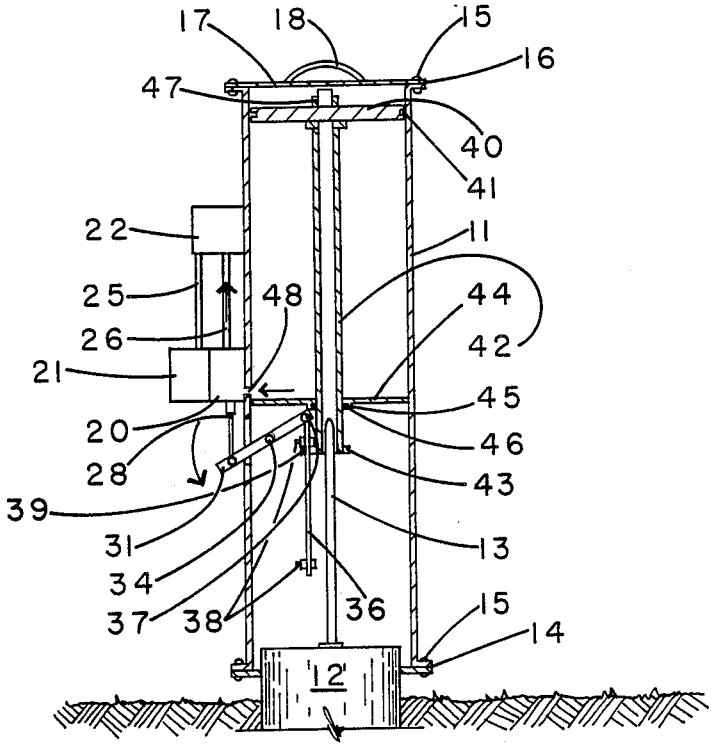
FIG. 3 is a cross-sectional view of a hydraulic pump jack with the piston at the beginning of its down stroke.
Figure 4:
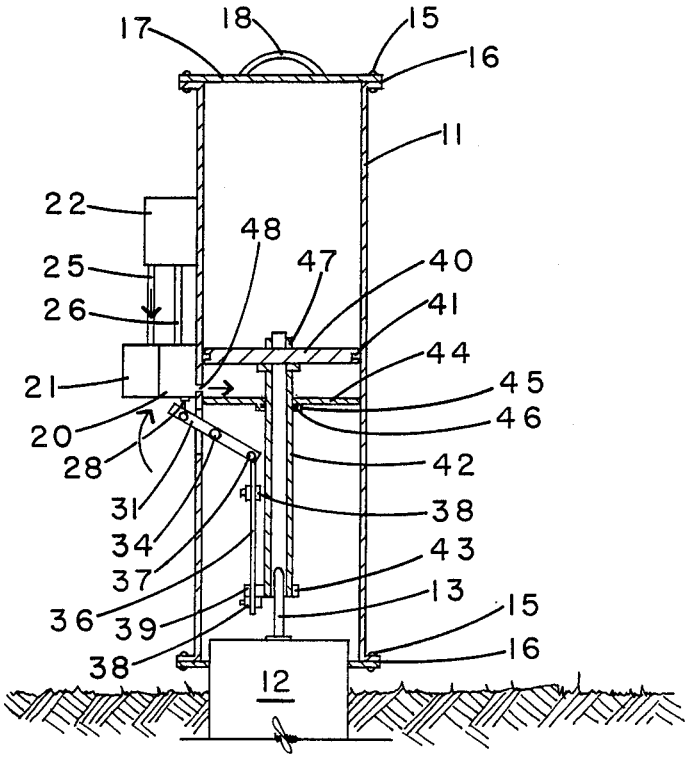
FIG. 4 is a cross-sectional view of a hydraulic pump jack with the piston at the beginning of its up stroke.
Figure 6:
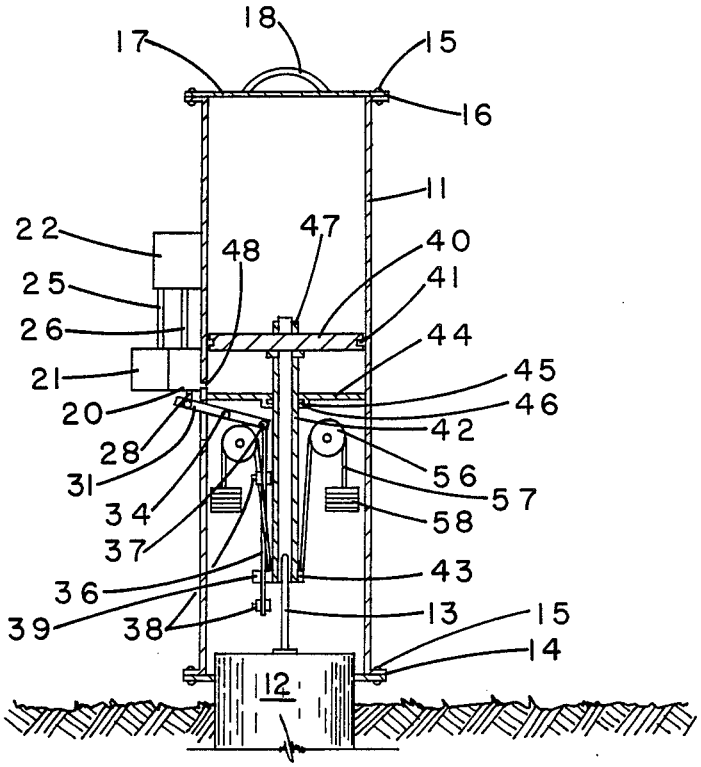
FIG. 6 is a cross-sectional view of a hydraulic pump jack with counter weights.

The operation of the pump jack will now be described. An inflow of hydraulic fluid through the orifice 48 causes the piston 40 to rise in the cylinder 11, thereby raising the sucker rod 13 of the oil well. When fluid pressure is released, the force of gravity on the sucker rod 13 and piston 40 causes the piston 40 to descend until fluid pressure is again applied for the upward pump stroke or until the piston 40 contacts the rod end cap 44. In the preferred embodiments, the inflow and exhaust of hydraulic fluid from the cylinder 11 is controlled by a conventional three-way spool valve (not shown). In the preferred embodiments, the valve unit 20 is actuated by a valve actuator rod 28 which may be positioned either "up" or "down". When the actuator rod 28 is in the "down" position, as shown in FIG. 3, hydraulic fluid within the cylinder 11 is allowed to pass out through the orifice 48 and through the valve unit 20 and exhaust line 26 into the hydraulic fluid reservoir 22. When the actuator rod 28 is in the "up" position, as shown in FIG. 3, hydraulic fluid is pumped from the reservoir 22 through the hydraulic fluid supply line 25, pumping unit 21, and valve unit 20, and orifice 48 into the pump jack cylinder 11. It may be seen from FIGS. 3 and 4 that the actuator rod 28 is placed in either the "up" or the "down" position by the relative motion of the adjuster bar guide 39, with respect to the adjuster stops 38. When the piston rod 42 has risen to a sufficient height, the adjuster bar guide 39 contacts the upper adjuster stop 38, causing a rotational movement of the pivot bar 31 and thence a downward movement of the valve actuator rod 28. A downward movement of the actuator rod 28 changes the porting arrangement within the valve unit 20 releasing the fluid pressure within the cylinder 11, thereby causing the piston rod 42 to begin its downward stroke. The actuator rod 28 remains on the "down" position until the piston rod 42 has descended sufficiently far to cause the adjuster bar guide 39 to contact the lower adjuster stop 28. The downward movement thus produced in the adjuster bar 36 causes an upward displacement of the actuator rod 28, which again changes the porting arrangement within the valve unit 20, causing the hydraulic fluid to flow into the cylinder 11, thereby beginning the upward piston 40 stroke, as shown in FIG. 4. It will be seen from the above, that by placing the adjuster stops 38 farther apart, the pump stroke is lengthened and conversely by moving the adjuster stops 38 closer together, the pump stroke is stortened. Pressure control units, or other control means (not shown) well known in the hydraulic arts, may be used to control or vary the speed of the punp stroke as may be desired for particular applications. In pump jacks 10 used on large wells and heavy pumping equipment, it is often necessary to provide counterweights in order to eliminate the need to overcome the gravitational force on the pump apparatus during each upward stroke. As shown in FIG. 6, this result may be accomplished by mounting pulleys 56 within the cylinder 11 immediately below the rod end cap 44. The pulleys 56 may be suspended from the rod end cap 44 or otherwise attached by conventional mounting means well known in the art. Cables 57 may then be attached to the lower end of the piston rod 42 and threaded over the pulleys 56. Weights 58, sufficient to offset the weight of the pumping apparatus 10, the sucker rod 13 and part of the load of fluid being pumped are then attached to the free end of the cable 57.

Figure 5:
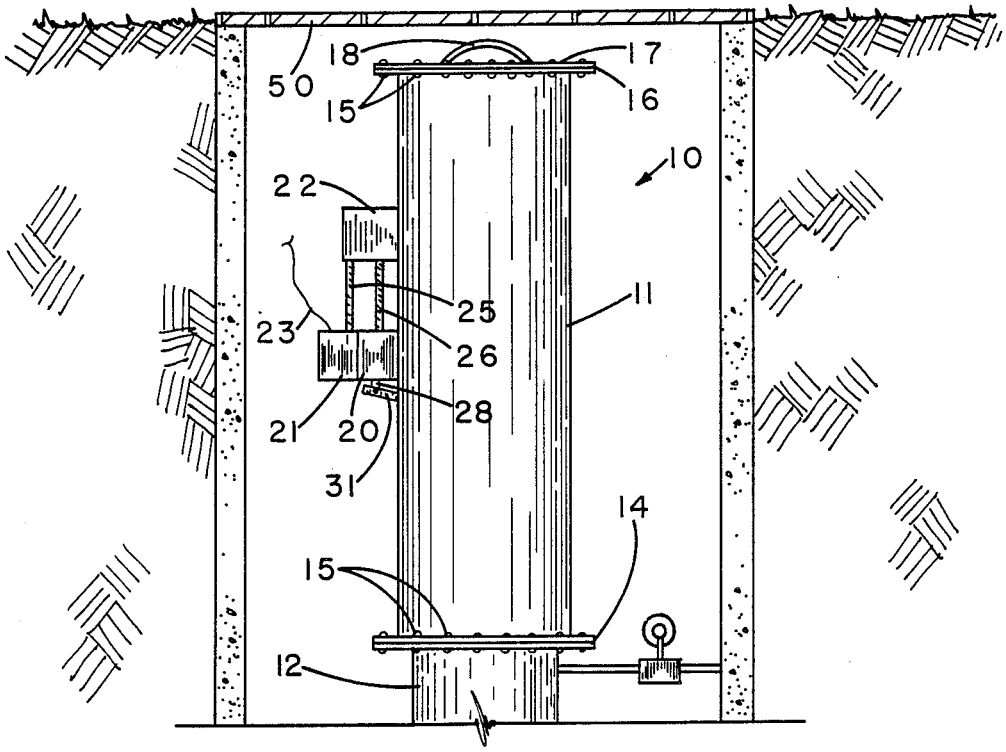
FIG. 5 is a cross-sectional view of a hydraulic pump jack mounted in an underground operating vault.
Figure 7:
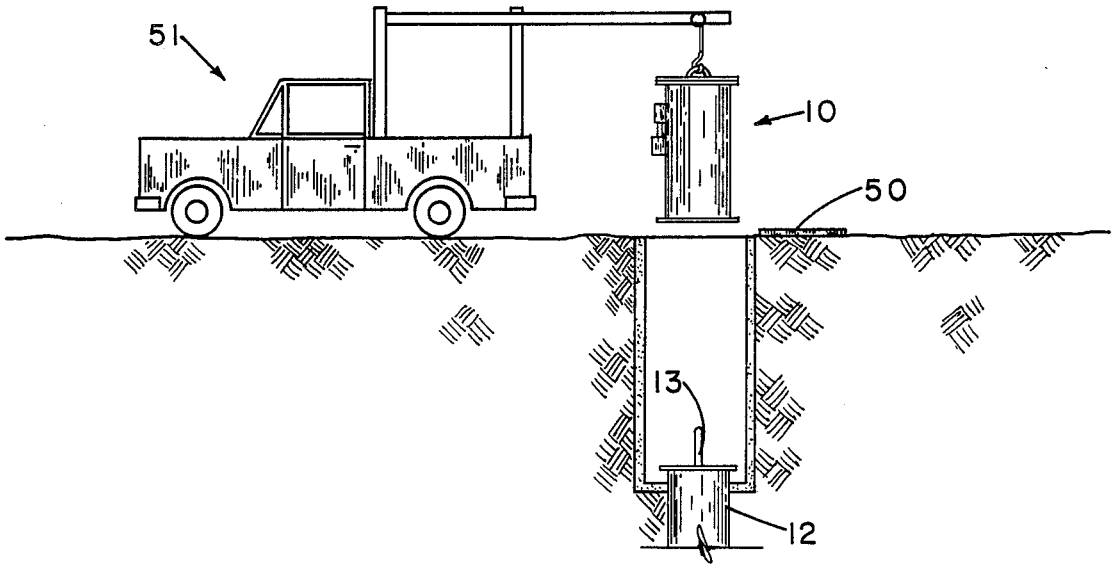
FIG. 7 is a side view showing removal of a hydraulic pump jack from an operating vault.

The compact nature of the hydraulic pump jack 10 of the present invention allows it to be conveniently mounted underground, as shown in FIGS. 5 and 7 in a manhole type vault arrangement. A manhole cover 50 may be provided to keep out moisture. The underground arrangement prevents freezing and other undesirable conditions associated with the weather experience in surface mounting, making the pumpjack 10 operational in a number of adverse weather environments where a surface pump might be unfeasible. The underground mounting is also desirable for a variety of land utilization purposes. As shown by FIG. 3, a metal loop 18 may be provided at the top of the pump jack 10 to facilitate placement and removal of the pump jack by means of a boom truck 51, or other hoisting device.

Thus, it can be seen that a hydraulic pump jack 10 has been provided which is compact in size, transportable, easily maintainable, and extremely reliable. Obviously, many modifications and variations of the described invention are possible. For example, a double acting cylinder might be employed rather than the single acting cylinder which was specifically described in the preferred embodiment. It is, therefore, understood within the scope of the inventor's claim that the invention may be practiced otherwise than as specifically described.

I claim:

1. In combination, a manhole type vault having upper and lower ends, said vault being situated in the ground with said upper end disposed approximately at ground level, a cover removably covering the upper end of said vault, an oil well casing disposed within the ground below said vault, said casing having an upper end portion protruding into said vault through the lower end thereof, and a hydraulic pump jack, comprising (a) hydraulic cylinder means mounted on the upper end of said oil well casing, (b) piston means slidably mounted within said hydraulic cylinder means;

(c) piston rod means having a first end and a second end wherein said first end is operably attached to said piston and said second end is operably attached to the oil well sucker rod;

(d) fluid forcing means for providing hydraulic fluid under pressure to said cylinder means;

(e) control valve means for controlling the flow of hydraulic fluid to said hydraulic cylinder;

said piston rod means comprising a tubular shaft for telescopingly accepting said oil well sucker rod, said hydraulic cylinder means comprising a rod end cap fixedly mounted within said hydraulic cylinder means whereby said hydraulic cylinder means is divided into an upper chamber and a lower chamber;

said piston rod means being slidingly mounted in said rod end cap and wherein said piston means is positioned in said upper chamber of said hydraulic cylinder means;

a hydraulic fluid return reservoir in fluid communication with said fluid forcing means and said control valve means; and said hydraulic cylinder means comprising a removable blind end cap positioned at the top end of the cylinder.

* * * * *